United States Patent [19]

Takahashi et al.

[11] Patent Number: 4,517,490

[45] Date of Patent: May 14, 1985

[54] DISPERSION TYPE ELECTROLUMINESCENT ELEMENT WITH LIQUID DIELECTRIC AND JELLING AGENT

[75] Inventors: Hideo Takahashi; Mitsuo Nakatani, both of Yokohama, Japan

[73] Assignee: Hitachi, Ltd., Tokyo, Japan

[21] Appl. No.: 381,306

[22] Filed: May 24, 1982

[30] Foreign Application Priority Data

May 27, 1981 [JP] Japan ..... 56-79353

[51] Int. Cl.[3] ..... H05B 33/20

[52] U.S. Cl. ..... 313/502

[58] Field of Search ..... 313/483, 494, 502, 358; 350/350 R, 350 F; 252/188.31

[56] References Cited

U.S. PATENT DOCUMENTS

| | | | |
|---|---|---|---|
| 2,941,104 | 6/1960 | Swindells | 313/502 X |
| 3,238,407 | 3/1966 | Jaffe | 313/502 |
| 3,775,631 | 11/1973 | Morikawa | 313/502 |

*Primary Examiner*—Palmer Demeo
*Assistant Examiner*—Sandra L. O'Shea
*Attorney, Agent, or Firm*—Antonelli, Terry & Wands

[57] ABSTRACT

A dispersion type electroluminescent element comprising dielectric, which is liquid at −20° to +60° C. and has a dielectric constant of 30–80, a gelling agent, and an electroluminescent phosphor, when used as an electroluminescent layer, has a practical brightness, which is never lowered for a long time, and has less disturbance to the electroluminescent surface.

11 Claims, No Drawings

DISPERSION TYPE ELECTROLUMINESCENT ELEMENT WITH LIQUID DIELECTRIC AND JELLING AGENT

BACKGROUND OF THE INVENTION

1. Field of the Invention

This invention relates to an electroluminescent element and particularly to a dispersion type electroluminescent element in which the electroluminescent layer existing between the electrode plates comprises an organic dielectric having a high dielectric constant and an electroluminescent phosphor.

2. Description of the Prior Art

The electroluminescent element is a planar light source capable of emitting luminescence of various colors with low power consumption. Particularly, a powdery dispersion type electroluminescent element can be readily prepared at a low cost with a relatively large area, and thus application of a powdery dispersion-type electroluminescent element to a display device, a display and a planar television, etc. is expected. However, the dispersion-type electroluminescent element has a poor brightness and a short life, and thus has not been practically used.

ZnS is a practical electroluminescent phosphor when used in the electroluminescent layer of an electroluminescent element. ZnS has such properties that (a) the brightness depends greatly upon the electric field and (b) the brightness increases substantially in proportion to the driving frequency, but the half-life of brightness decreases in inverse proportion to the driving frequency. Thus, in the production of an electroluminescent element having a long half-life of brightness from ZnS particles, it is necessary to obtain practical brightness with a low driving frequency. One means is by uniformly dispersing ZnS particles into a dielectric having a high dielectric constant in an electroluminescent layer existing between electrode plates and increasing the electric field application to the phosphor particles in the electroluminescent layer to a maximum. Since the electroluminescent layer is in a film state, an organic dielectric that can be readily made into a film must be used as the dielectric having a high dielectric constant. Those organic dielectrics known to have a high dielectric constant, which can be readily made into a film, include cyanoethylated cellulose, cyanoethylated polyvinyl alcohol, etc. which have a dielectric constant of 12 to 21.

Organic dielectrics having a dielectric constant of 30 or higher are in a liquid state at room temperature. When electroluminescent phosphor particles are dispersed into a liquid organic dielectric to prepare an electroluminescent layer, a practical brightness can be obtained in the initial period, but the phosphor particles migrate and undergo condensation while the layer is subjected to emission of electroluminescence under application of an electric field, and the electroluminescent surface is disturbed resulting in a failure to display. To improve such phenomena, it was tried to use a mixture of a liquid organic dielectric having a high dielectric constant and cyanoethylated cellulose or cyanoethylated polyvinyl alcohol having a dielectric of 12 to 21 in the electroluminescent layer, but it was found that the dielectric constant of such a mixture was 20–30% lower than that of the original liquid organic dielectric.

SUMMARY OF THE INVENTION

An object of the present invention is to provide a dispersion-type electroluminescent element having an improved brightness without disturbing in the electroluminescent surface for a long period of time by eliminating the aforementioned disadvantages of the prior art.

The object of the present invention is attained by using a gel or solid state mixture of an organic dielectric having a high dielectric constant and a liquid state at a temperature of from −20° to +60° C., and a gelling agent for an organic dielectric having a dielectric constant of 30 or higher in a dispersion-type electroluminescent element which comprises a pair of juxtaposed electrodes and an electroluminescent layer therebetween, the electroluminescent layer comprising an electroluminescent phosphor uniformly dispersed in a dielectric.

Materials, etc. for use in the present invention will be described below.

The liquid organic dielectric having a high dielectric constant at a temperature of from −20° to +60° C. includes cyanoethylated phthalic acid esters, for example, d-α cyanoethylated phthalate ($\epsilon=30$), and cyanoethylated polyols, for example, cyanoethylated saccharose ($\epsilon=36$–38), cyanoethylated D-sorbitol ($\epsilon=48$–50), cyanoethylated mannitol ($\epsilon=47$–49), cyanoethylated thioglycol ($\epsilon=60$–70), cyanoethylated glycerol ($\epsilon=48$–50), cyanoethylated diglycerol ($\epsilon=78$–80), cyanoethylated trimethylolethane ($\epsilon=30$–32), etc. These compounds are used alone or in a mixture of at least two thereof. The degree of cyanoethylation of the organic dielectric having a high dielectric constant is in a range of 85 to 100%.

The gelling agent includes polymer compounds such as, peroxyethylene, etc., and acetals obtained by condensation of benzaldehyde or nuclearly substituted benzaldehyde with polyhydric alcohols having at least 5 hydroxyl groups, preferably 5 to 8 hydroxyl groups. Above all, the acetals obtained by condensation of benzaldehyde or nuclearly substituted benzaldehyde with polyhydric alcohol having at least 5 hydroxyl groups, preferably 5 to 8 hydroxyl groups are preferable. Among the acetals, those of dibenzylidene series and tribenzylidene series are preferable. The acetals of dibenzylidene series include, for example, dibenzylidene-D-sorbitol, dibenzylidene mannitol, dibenzylidene xylitol, etc., and the acetals of tribenzylidene series include, for example, tribenzylidene-D-sorbitol, tribenzylidene mannitol, tribenzylidene splitol, etc. These compounds are used alone or in mixture of at least two thereof.

90 to 99.9% by weight, preferably 90 to 95% by weight, more preferably 97 to 98% by weight of the cyanoethylated polyol or cyanoethylated phthalic acid ester is mixed with 10 to 0.1% by weight, preferably 10 to 5% by weight, more preferably 3 to 2% by weight of the gelling agent. When the gelling agent is in a mixing ratio of 0.1 to 10% by weight, the cyanoethylated polyol or cyanoethylated phthalic acid ester can be modified to a gel or solid state at room temperature without any substantial lowering of the dielectric constant of cyanoethylated polyol or cyanoethylated phthalic acid ester. Below 0.1% by weight, satisfactory gelation cannot be obtained, whereas above 10% by weight, the lowering of dielectric constant is remarkable.

The organic dielectric having a high dielectric constant and forming a gel or solid state at room temperature becomes flowable when heated, for example, to 100° C., and forms a gel or solid state again when cooled to room temperature Thus, an electroluminescent layer can be prepared by mixing the organic dielectric in a flowable state with a predetermined amount of an electroluminescent phosphor, applying the resulting mixture to electrode plates, and cooling the plates to room temperature.

The organic dielectric in a gel or solid state is readily soluble in a polar solvent such as acetonitrile, n-methyl-2-pyrolidone, etc., and thus an electroluminescent layer can also be prepared by dissolving the organic dielectric in a gel or solid state and the electroluminescent phosphor in the polar solvent to make a paste, applying the paste to electrode plates, and then evaporating the solvent.

An insulating reflective layer of white inorganic substance having a high dielectric constant such as fine barium titanate particles can be formed at the back side to the light emission side of the electroluminescent layer.

The present invention will be described in detail below, referring to Examples.

DESCRIPTION OF THE PREFERRED EMBODIMENTS

EXAMPLE 1

A mixture of 97% by weight of cyanoethylated saccharose in a sticky state at room temperature and 3% by weight of white powder of dibenzylidene-D-sorbitol as a gelling agent were uniformly mixed and homogenized while heating to about 120° C. The resulting flowable mixture was cooled to room temperature, whereby the flowability was lost and gelation took place, and finally a substantially solid state was obtained.

The dielectric characteristics before and after the gelation were investigated. Cyanoethylated saccharose originally had a dielectric constant of 36 to 38 and tan δ of 5% at 120 Hz, whereas it had a dielectric constant of 35–38 and tan δof 5% at 120 Hz after the gelation. The dielectric constant was slightly changed without any change in tan δ.

In the case of a mixture of 95% by weight of cyanoethylated saccharose and 5% by weight of dibenzylidene-D-sorbitol, the rate of gelation increased in comparison with the former mixture containing 3% by weight of dibenzylidene-D-sorbitol. The dielectric constant was 35 to 36.

EXAMPLE 2

Cyanoethylated sorbitol and cyanoethylated mannitol, both being clear liquid materials at room temperature, were used.

A mixture of 95% by weight of cyanoethylated sorbitol and 5% by weight of dibenzylidene-D-sorbitol as a gelling agent was mixed and homogenized while heating to about 130° C. When the resulting liquid mixture was cooled to room temperature, the flowability was gradually lost, and gelation took place.

Dielectric characteristics before and after the gelation were investigated. Cyanoethylated sorbitol originally had a dielectric constant of 48–50 and tan δ about 6% at 120 Hz, whereas it had a dielectric constant of 48 to 49 and tan δ of 6% at 120 Hz after the gelation. The dielectric constant was slightly changed without any change in tan δ.

A similar test was carried out for cyanoethylated mannitol. Complete gelation took place by addition of 5% by weight of benzylidene-D-sorbitol as a gelling agent.

The dielectric characteristics before and after the gelation were investigated. Cyanoethylated mannitol originally had a dielectric constant of 46–47 and tan δ of 5.8% at 120 Hz, whereas it had a dielectric constant of 45 to 46 and tan δ of 5.8% after the gelation. The dielectric constant was slightly changed without any change in tan δ.

EXAMPLE 3

A gel-like mixture of 95% by weight of cyanoethylated saccharose and 5% by weight of benzylidene-D-sorbitol, which was substantially in a solid state at room temperature, and prepared in the same manner as Example 1, had a flowability at about 100° C., but gelled again at room temperature to take a substantially solid state.

100 parts by weight of the gel-like mixture was admixed with 300 parts by weight of electroluminescent ZnS phosphor and the resulting mixture was heated and melted at 130° C. for homogenization. By successive heating under a reduced pressure, low boiling absorbed gases, etc. were removed therefrom. When the resulting mixture was cooled at room temperature, a very hard solid state was obtained.

Then, the resulting mixture containing the phosphor was placed between a pair of juxtaposed transparent electrode plates through a space having a thickness of about 45 μm in a heated dry atmosphere at 130° C. and joined together in a heated and melted state. The peripheral edges of the plates were sealed by paraffin, or the like, and the plates were cooled to solidify the mixture. Thus, an electroluminescent element was prepared.

The brightness of the element was found to be 6–7 ft-L at 50 Hz and 100 V, and 15–17 ft-L at 50 Hz and 200 V. No abnormal state was found on the electroluminescent surface under continued application of 50 Hz and 100 V, and the half-life of brightness was 4,000 hours, and the element could be used for minimum 20,000 hours.

EXAMPLE 4

A cell having an electrode-interfacial distance of about 45 μm was prepared from a pair of juxtaposed transparent, electroconductive glass plates by placing the electrode sides of the plates against each other, and joining the plates together at their peripheral edges by a low melting glass while leaving two pouring openings.

Then, the gel-like mixture containing the phosphor as prepared in Example 3 was heated to a flowable state in a heated dry atmosphere at 130° C. and filled into the cell through one pouring opening under pressure, while exhausting the cell at other pouring opening. After the filling, the two pouring openings were sealed by a thermo-setting type epoxy resin or an ultraviolet-setting type adhesive, and then the cell was cooled to room temperature for solidification. Thus, an electroluminescent element was prepared.

The element had a brightness of 6–7 ft-L at 50 Hz and 100 V as in Example 3, and no abnormal state was found on the electroluminescent surface under continued application of 50 Hz and 100 V. The half-life of brightness was about 4,000 hours, and the element could be used for minimum 20,000 hours.

EXAMPLE 5

A mixture of 97% by weight of cyanoethylated saccharose having a high dielectric constant and forming a liquid state at room temperature and 3% by weight of white powder of dibenzylidene-D-sorbitol as a gelling agent was dissolved in n-methyl-2-pyrolidone as a solvent to prepare a solution containing about 20% by weight of the mixture.

10 parts by weight of the solution was admixed with 6 parts by weight of electroluminescent ZnS phosphor powder of green light emission and the resulting mixture was homogenized by stirring to prepare a phosphor paste.

Separately, 10 parts by weight of the solution was admixed with 12 parts by weight of fine barium titanate powder to prepare a reflective layer paste.

Then, the said phosphor paste was applied to the nesa film of a nesa glass plate by screen printing, and dried to form a phosphor layer having a thickness of about 35 μm after drying. Successively, the reflective layer paste was applied to the phosphor layer and dried to form a reflective layer having a thickness of about 10 μm after drying. Total film thickness after drying was about 45 μm.

Then, a back side electrode was formed on the reflective layer by aluminum vacuum vapor deposition, and provided with electrode terminals, and further subjected to moisture-proof sealing in a heated dry atmosphere at 130° C. to prepare an electroluminescent element.

The brightness of the element was found to be 7–8 ft-L at 50 Hz and 100 V and 15–18 ft-L at 50 Hz and 200 V, and the half-life of brightness was about 4,000 hours, and the element could be used for minimum 20,000 hours. No abnormal state was observed under continued application of 50 Hz and 100 V.

EXAMPLE 6

The two kinds of gel-like organic dielectrics of Example 2 were mixed with ZnS to prepare 4 kinds of mixtures according to the respective procedures of Examples 3 and 5. Then, 8 kinds of elements were prepared from these 4 kinds of the mixtures according to the respective procedure of Examples 3 and 5.

The brightness and the half-life of brightness of these 8 elements were measured. The brightness was about 8 ft-L at 50 Hz and 100 V and about 20 ft-L at 50 Hz and 200 V for all the elements and no abnormal state was observed on the electroluminescent surfaces under continued application of 50 Hz and 100 V. The half-life of brightness was about 4,000 hours, and all the elements could be used for minimum 20,000 hours.

What is claimed is:

1. A dispersion-type electroluminescent element which comprises a pair of juxtaposed electrode plates, and a mixture of a dielectric and an electroluminescent phosphor existing between the electrode plates, the dielectric consisting of:

90 to 99.9% by weight of a liquid dielectric having a dielectric constant of 30 to 80 at a room temperature from −20° to +60° C. and being at least one of cyanoethylated polyol and cyanoethylated phthalic acid ester, and 10 to 0.1% by weight of a gelling agent that is at least one of peroxyethylene, and acetals as condensates of benzaldehyde or nuclearly substituted benzaldehydes with a polyhydric alcohol having at least 5 hydroxyl groups.

2. The dispersion-type electroluminescent element according to claim 1, wherein the liquid dielectric is at least one of cyanoethylated polyol and cyanoethylated phthalic acid esters, and the gelling agent is at least one of peroxyethylene, and acetals as condensates of benzaldehyde or nuclearly substituted benzaldehyde with a polyhydric alcohol having 5 to 8 hydroxyl groups.

3. The dispersion-type electroluminescent element according to claim 1 wherein the liquid dielectric is at least one of cyanoethylated polyol and cyanoethylated phthalic acid ester, and the gelling agent is at least one of acetals as condensate of benzaldehyde or nuclearly substituted benzaldehyde with a polyhydric alcohol having 5 to 8 hydroxyl groups.

4. The dispersion-type electroluminescent element according to claim 1 wherein the liquid dielectric is at least one of cyanoethylated saccharose, cyanoethylated D-sorbitol, cyanoethylated mannitol, cyanoethylated thioglycol, cyanoethylated glycerol, cyanoethylated diglycerol, cyanoethylated trimethylolethane, and d-c-cyanoethylated phthalate, and the gelling agent is at least one of peroxyethylene, acetals of dibenzylidene series, and acetals of tribenzylidene series.

5. The dispersion-type, electroluminescent element according to claim 3, wherein the acetals of dibenzylidene series are dibenzylidene-D-sorbitol, dibenzylidene mannitol, and dibenzylidene xylytol, and the acetals of tribenzylidene series are tribenzylidene-D-sorbitol, tribenzylidene mannitol and tribenzylidene xylytol.

6. A dispersion-type electroluminescent element which comprises a pair of juxtaposed electrode plates, and a mixture of a dielectric and an electroluminescent phosphor existing between the electrode plates, the dielectric consisting of a liquid dielectric having a dielectric constant of 30 to 80 at a temperature from −20° to +60° C. and being at least one of cyanoethylated polyol and cyanoethylated phthalic acid ester, and a gelling agent that is at least one of peroxyethylene, and acetals as condensates of benzaldehyde or nuclearly substituted benzaldehydes with a polyhydric alcohol having at least 5 hydroxyl groups.

7. The dispersion-type electroluminescent element according to claim 6, wherein the dielectric consists of 90 to 99.9% by weight of the liquid dielectric and 10 to 0.1% by weight of the gelling agent.

8. The dispersion-type electroluminescent element according to claim 6, wherein the liquid dielectric is at least one of cyanoethylated polyol and cyanoethylated phthalic acid esters, and the gelling agent is at least one of peroxyethylene, and acetals as condensates of benzaldehyde or nuclearly substituted benzaldehyde with a polyhydric alcohol having 5 to 8 hydroxyl groups.

9. The dispersion-type electroluminescent element according to claim 6, wherein the liquid dielectric is at least one of cyanoethylated polyol and cyanoethylated phthalic acid ester, and the gelling agent is at least one of acetals as condensate of benzaldehyde or nuclearly substituted benzaldehyde with a polyhydric alcohol having 5 to 8 hydroxyl groups.

10. The dispersion-type electroluminescent element according to claim 6, wherein the liquid dielectric is at least one of cyanoethylated saccharose, cyanoethylated D-sorbitol, cyanoethylated mannitol, cyanoethylated thioglycol, cyanoethylated glycerol, cyanoethylated diglycerol, cyanoethylated trimethylolethane, and d-α-cyanoethylated phthalate, and the gelling agent is at least one of peroxyethylene, acetals of dibenzylidene series, and acetals of tribenzylidene series.

11. The dispersion-type, electroluminescent element according to claim 9, wherein the acetals of dibenzylidene series are dibenzyldiene-D-sorbitol, dibenzylidene mannitol, and dibenzylidene xylytol, and the acetals or tribenzylidene series are tribenzylidene-D-sorbitol, tribenzylidene mannitol and tribenzylidene xylytol.

* * * * *